US008157017B2

(12) United States Patent
Turner et al.

(10) Patent No.: US 8,157,017 B2
(45) Date of Patent: Apr. 17, 2012

(54) METHOD AND APPARATUS FOR INJECTING FLUID IN A WELLBORE

(75) Inventors: Dewayne Turner, Tomball, TX (US); Richard Ross, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 254 days.

(21) Appl. No.: 12/565,996

(22) Filed: Sep. 24, 2009

(65) Prior Publication Data

US 2011/0067876 A1 Mar. 24, 2011

(51) Int. Cl.
*E21B 34/10* (2006.01)

(52) U.S. Cl. ..... 166/375; 166/321; 166/332.1; 166/386

(58) Field of Classification Search ..... None
See application file for complete search history.

(56) References Cited

U.S. PATENT DOCUMENTS

| | | | | |
|---|---|---|---|---|
| 4,565,215 | A | 1/1986 | Cummings et al. | |
| 5,004,007 | A | 4/1991 | Johnson et al. | |
| 5,014,787 | A | 5/1991 | Duerksen | |
| 5,123,485 | A | 6/1992 | Vasicek et al. | |
| 5,131,471 | A | 7/1992 | Duerksen et al. | |
| 5,579,838 | A | 12/1996 | Michael | |
| 6,070,663 | A | 6/2000 | Cernocky et al. | |
| 2007/0163781 | A1 | 7/2007 | Walker | |
| 2009/0218102 | A1 * | 9/2009 | Casciaro | 166/321 |

FOREIGN PATENT DOCUMENTS

| | | | |
|---|---|---|---|
| GB | 2377721 | A | 1/2003 |
| GB | 2399368 | A | 9/2004 |

OTHER PUBLICATIONS

International Search Report and Written Opinion for PCT/US2010/049982 dated May 19, 2011.

* cited by examiner

*Primary Examiner* — Zakiya W Bates
(74) *Attorney, Agent, or Firm* — Parsons Behle & Latimer

(57) ABSTRACT

A chemical injection system for controlling injection of an injection fluid from an injection fluid supply at a surface location into a production tubing assembly having an upper flow path, a first flow zone, and a second flow zone. The chemical injection system comprises a first fluid injection line configured to inject the injection fluid into the first flow zone and a second fluid injection line configured to inject the injection fluid into the second flow zone. A main fluid supply line is configured to fluidly connect both the first fluid injection line and the second fluid injection line to the injection fluid supply.

22 Claims, 5 Drawing Sheets

METHOD AND APPARATUS FOR INJECTING FLUID IN A WELLBORE

BACKGROUND

1. Field of the Disclosure

The present disclosure relates generally to apparatus for subterranean wellbores, and in particular, to an injection system for controlling the flow of injection fluids into subterranean wellbores.

2. Description of the Related Art

The present disclosure generally relates to hydrocarbon producing wells where production of the well can benefit from injection of a fluid during well operation. More specifically, injection of a fluid from the surface through a small diameter, or capillary, tubing. Exemplary, non-limiting applications of fluid injection include: injection of surfactants and/or foaming agents to aid in water removal from a gas well; injection of de-emulsifiers for production viscosity control; injection of scale inhibitors; injection of inhibitors for asphaltine and/or diamondoid precipitates; injection of inhibitors for paraffin deposition; injection of salt precipitation inhibitors; injection of chemicals for corrosion control; injection of lift gas; injection of water; and injection of any production-enhancing fluid.

Intelligent systems for hydrocarbon producing wells are well known in the art. These systems can allow production from a well having multiple production zones with reduced or no mechanical intervention. Instead, intelligent well assemblies can employ simple hydraulics or applied hydraulic systems or electrical systems, which may include, for example, hydraulically or electrically operated valves to control the production and fluid flow within a multi-zone well. Such intelligent equipment is well known in the art, and may employ, for example, applied pressure and ventilation for cylinder movement downhole.

Injection of fluids into multi-zone wells is often complicated by the existence of multiple production zones in a single well. Current multi-zone well injection technology often employs a separate injection line for each zone. Other multi-zone well technologies provide continuous injection into all zones regardless of which zones are being produced. While advancements have been made for injecting fluids into multi-zone wells and/or intelligent production wells, improvements in injection technology are needed. Accordingly, the present disclosure is directed to providing an improved system for injecting fluids into production wells, including multi-zone and/or intelligent production wells, or any other wells that can benefit from improved injection technology

SUMMARY

An embodiment of the present disclosure is directed to a production tubing assembly. The production tubing assembly comprises an upper flow path, a first flow zone and a second flow zone. The production tubing assembly also comprises a first valve sleeve having an open position and a closed position. The first valve sleeve allows fluid communication between the first flow zone and the upper flow path when the first valve sleeve is in the open position. The first valve sleeve prevents fluid communication between the first flow zone and the upper flow path when the first valve sleeve is in the closed position. The production tubing assembly also comprises a second valve sleeve having an open position and a closed position. The second valve sleeve is configured to allow fluid communication between the second flow zone and the upper flow path when the second valve sleeve is in the open position.

The second valve sleeve is configured to prevent fluid communication between the second flow zone and the upper flow path when the second valve sleeve is in the closed position. The production tubing assembly also comprises a chemical injection system configured to inject an injection fluid from an injection fluid supply at a surface location. The first fluid injection line is configured to inject the injection fluid into the first flow zone and a second fluid injection line is configured to inject the injection fluid into the second flow zone. A main fluid supply line is configured to fluidly connect both the first fluid injection line and the second fluid injection line to the injection fluid supply. A first injection valve is configured to allow injection fluid to flow through the first fluid injection line to the first flow zone when the first valve sleeve is in the open position. The first injection valve is configured to stop injection fluid flow to the first flow zone when the first sleeve is in the closed position. A second injection valve is configured to allow injection fluid to flow through the second fluid injection line to the second flow zone when the second valve sleeve is in the open position. The second injection valve is configured to stop injection fluid flow to the second flow zone when the second sleeve is in the closed position.

Another embodiment of the present disclosure is directed to a chemical injection system for controlling injection of an injection fluid from an injection fluid supply at a surface location into a production tubing assembly having an upper flow path, a first flow zone, a second flow zone, a first valve sleeve for controlling flow between the upper flow path and the first flow zone, and a second valve sleeve for controlling flow between the upper flow path and the second flow zone. The chemical injection system comprises a first fluid injection line configured to inject the injection fluid into the first flow zone and a second fluid injection line configured to inject the injection fluid into the second flow zone. A main fluid supply line is configured to fluidly connect both the first fluid injection line and the second fluid injection line to the injection fluid supply. A first injection valve is configured to allow injection fluid to flow through the first fluid injection line to the first flow zone when the first valve sleeve is in an open position. The first injection valve is also configured to stop injection fluid flow to the first flow path when the first sleeve is in a closed position. A second injection valve is configured to allow injection fluid to flow through the second fluid injection line to the second flow zone when the second valve sleeve is in an open position. The second injection valve is also configured to stop injection fluid flow to the second flow zone when the second sleeve is in a closed position.

Yet another embodiment of the present disclosure is directed to a method for controlling a flow of injection fluid from a surface location into a production tubing assembly having an upper flow path, a first flow zone, a second flow zone, a first valve sleeve for controlling flow between the upper flow path and the first flow zone, and a second valve sleeve for controlling flow between the upper flow path and the second flow zone. The method comprises opening the first valve sleeve to flow production fluid into the upper flow path from the first flow zone. The process of opening the first valve sleeve also opens a first injection valve to flow the injection fluid through the first fluid injection line from the surface location to the first flow zone. The method further comprises opening the second valve sleeve to flow production fluid into the upper flow path from the second flow zone. The process of opening the second valve sleeve also opens a second injection valve to flow the injection fluid through the second fluid injection line from the surface location to the second flow zone.

Figure 1:
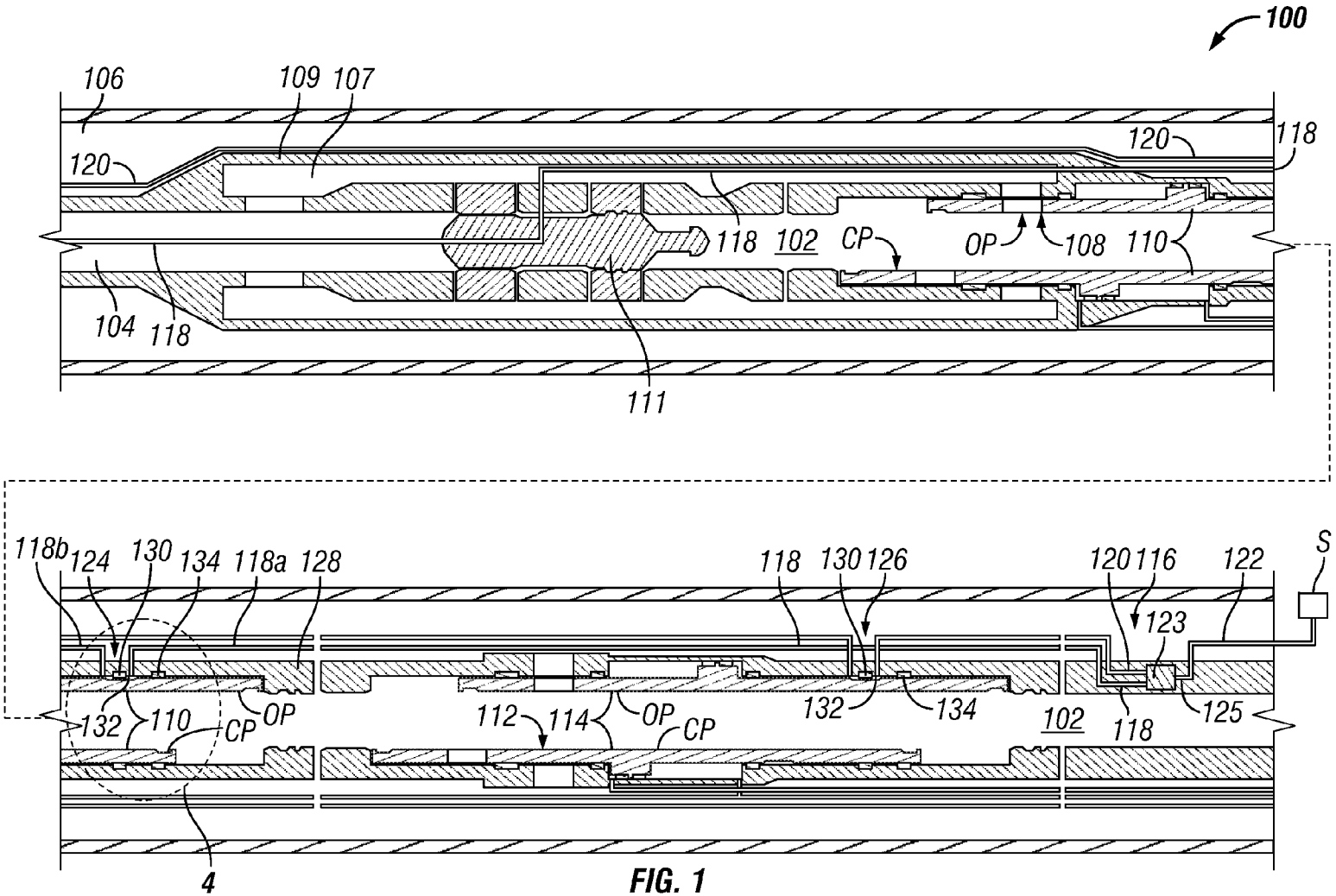
FIG. 1 illustrates a production tubing assembly 100, according to an embodiment of the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

The present disclosure generally relates to hydrocarbon producing wells where production of the well can benefit from continuous injection of a fluid, such as injection of a fluid from the surface through a small diameter, or capillary, tubing. Exemplary applications of fluid injection include: injection of surfactants and/or foaming agents to aid in water removal from a gas well; injection of de-emulsifiers for production viscosity control; injection of scale inhibitors; injection of inhibitors for asphaltine and/or diamondoid precipitates; injection of inhibitors for paraffin deposition; injection of salt precipitation inhibitors; injection of chemicals for corrosion control; injection of lift gas; injection of water and injection of any production-enhancing fluid. Injection of the above listed substances into hydrocarbon producing wells is generally well known in the art.

FIG. 1 illustrates a production tubing assembly 100, according to an embodiment of the present application. Production tubing assembly 100 can be employed in any suitable well completion assembly. For example, production tubing assembly 100 can be employed for controlling flow in a multi-zone subsea well completion assembly.

Production tubing assembly 100 can include an upper flow path 102, a first flow zone 104 and a second flow zone 106. In an embodiment, the first flow zone 104 can comprise a tubing string inner diameter flow path and the second flow zone 106 can comprise an annular flow path around the tubing string inner diameter flow path. In another embodiment, both the first zone 104 and the second zone 106 can comprise annular flow paths.

In an embodiment, the first flow zone 104 can further include a diversion flow path 107. The diversion flow path 107 can be formed by a shroud 109 positioned around the tubing string inner diameter. A plug 111 can be positioned in the tubing string inner diameter flow path for diverting flow through the diversion flow path 107 to the upper flow path 102.

The flow of production fluids from first flow zone 104 and second flow zone 106 can be controlled using a first valve 108 and a second valve 112, respectively. First valve 108 includes a first valve sleeve 110 and second valve 112 includes a second valve sleeve 114. Both valve sleeves 110 and 114 have an open position, OP, and a closed position, CP. For illustrative purposes only, FIG. 1 shows one side of the valve sleeves 110 and 114 in the open position and the other side of the valve sleeves 110 and 114 in the closed position. It is to be understood that both sides of valve sleeves 110 are cross sections of a single sleeve, where the entire sleeve will move between the open and closed positions as a single integral unit.

The first valve sleeve 110 allows fluid communication between the first flow zone 104 and the upper flow path 102 when the first valve sleeve 110 is in the open position, OP, and prevents fluid communication between the first flow zone 104 and the upper flow path 102 when in the closed position, CP. Similarly, second valve sleeve 114 allows fluid communication between the second flow zone 106 and the upper flow path 102 when the second valve sleeve 114 is in the open position, OP, and prevents fluid communication between the second flow zone 106 and the upper flow path 102 when in the closed position, CP.

Production tubing assembly 100 also includes a fluid injection system 116 for injecting an injection fluid that flows from an injection fluid source supply, S, at a surface location. A first fluid injection line 118 can be configured to inject the injection fluid into the first flow zone 104. For example, as illustrated in FIG. 1, the fluid injection line 118 can be configured to flow through the plug 111 to inject the injection fluid into the tubing string inner diameter flow path positioned below the plug 111. This can allow injection fluid to be introduced at a suitable depth below the plug 111. Injecting at lower depths in the well can provide for certain advantages, such as, for example, improved mixing of the injection fluid with the production fluid. In an alternative embodiment, fluid injection line 118 can be configured to inject the injection fluid into the diversion flow path 107. A second fluid injection line 120 can be configured to inject the injection fluid into the second flow zone 106 at any suitable location.

The fluid injection lines 118,120 can include, for example, capillary tubing and/or small diameter bores through portions of the production tubing assembly 100, or any other suitable means for providing the desired fluid flow. A main fluid supply line 122 can fluidly connect both the first fluid injection line 118 and the second fluid injection line 120 to the injection fluid supply, S. In an embodiment, the main fluid supply line 122 fluidly connects to the fluid injection lines 118,120 through a tee 123. In an embodiment, one or more check valves (not shown) can be employed at various locations in the fluid injection lines to reduce or prevent the undesired flow of production fluids up through the injection lines. In embodiments, check valves can be employed in the tee, the fluid injection lines 118,120 and/or the main fluid supply line 122.

In an embodiment, one or more rupture discs can also be employed in the fluid injection lines 118,120 or supply line 122. Rupture discs can be used as a means to test the lines once the lines are at depth. The rupture discs (not shown) can be positioned at any desired location, such as, for example, at location 125 in the fluid supply line 122. The line 122 can be filled and then attached to the production tubing at tee 123 prior to being run into the well. Applied pressure will rupture the disc and operators will often shear the disc once the tool is below the rotary (not shown).

A first injection valve 124 can be configured to allow injection fluid to flow through the first fluid injection line 118 when the first valve sleeve 110 is in the open position, while stopping injection fluid flow when the first valve sleeve 110 is in the closed position. In this manner, the first injection valve 124 can be opened and closed concurrently with valve 108.

Figure 4:
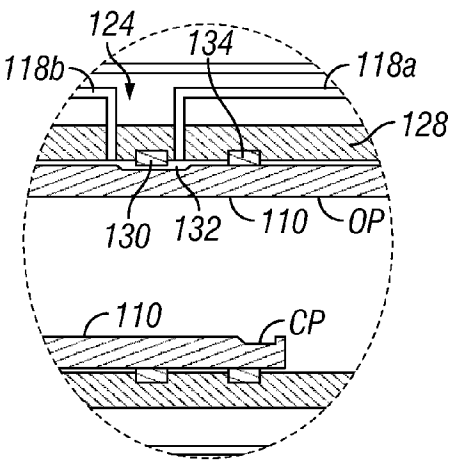
FIG. 4 illustrates an enlarged view of an injection valve of FIG. 1, according to an embodiment of the present disclosure.

In an embodiment, the first valve sleeve 110 is part of the first injection valve 124. As more clearly illustrated in FIG. 4, the first valve sleeve 110 can be configured so that moving the first valve sleeve 110 opens and closes the first injection valve 124. For example, sections 118*a* and 118*b* of first fluid injection line 118 can pass through a portion of tubing string 128 positioned adjacent to the valve sleeve 110 on either side of a seal 130. The first valve sleeve 110 can be configured to include a groove 132. As the valve sleeve 110 slides along the tubing string 128 between the open position, OP, and closed position, CP, the groove 132 moves relative to the seal 130. When the valve sleeve 110 is in the open position, the groove 132 is aligned so as to provide a conduit around seal 130 and thereby provide fluid communication between section 118*a* and section 118*b* of the first fluid injection line 118.

When the valve sleeve 110 is in the closed position, the first valve sleeve 110 seals against seal 130, thereby isolating section 118*a* from section 118*b*. In this manner, valve sleeve 110 opens the first injection valve 124 when the first valve 108 opens, and closes the first injection valve 124 when the first valve 108 closes.

A second injection valve 126 can be configured to allow injection fluid to flow through the second fluid injection line 120 to the second flow zone 106 when the second valve sleeve 114 is in the open position, while stopping injection fluid flow through the second fluid injection line 120 when the second valve sleeve 114 is in the closed position. In a similar manner to that described above for the first injection valve 124, the second valve sleeve 114 can form part of the second injection valve 126. The second injection valve 126 can thereby function in a similar manner to the first injection valve 124, opening and closing simultaneously with the second valve 112 as the valve sleeve 114 moves between the open position and closed position.

An alternative injection valve design is illustrated in FIGS. 2A to 2C and FIG. 3. The production tubing assembly 200 illustrated in FIGS. 2A to 2C can be similar to that described above for the embodiment of FIG. 1, except that the valve sleeves (e.g., 210 shown in FIG. 2B) are separate from the injection valve 224.

Figure 2A:
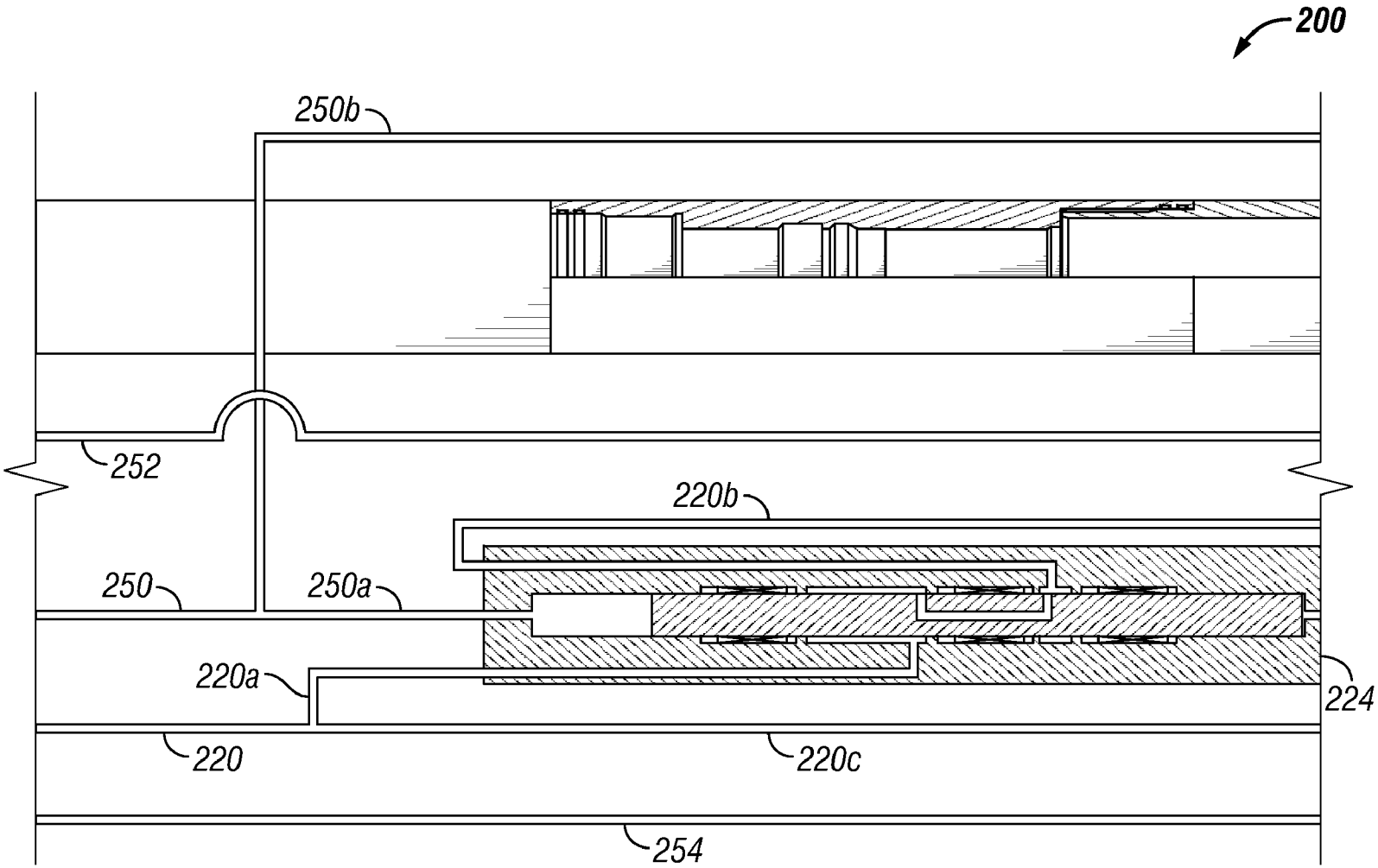
FIG. 2A-2C illustrates a production tubing assembly 200, according to an embodiment of the present disclosure.
Figure 2B:
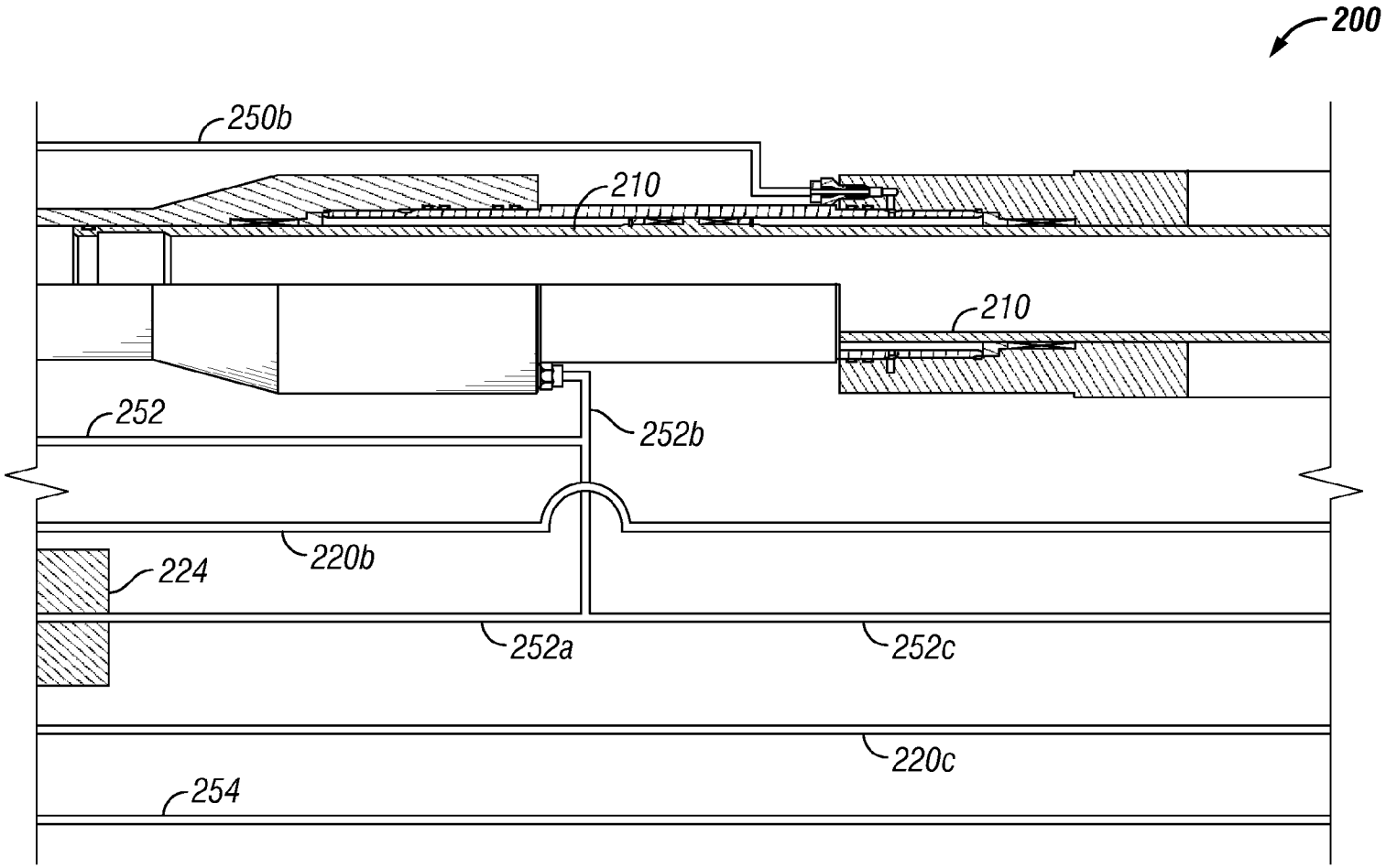
Figure 2C:
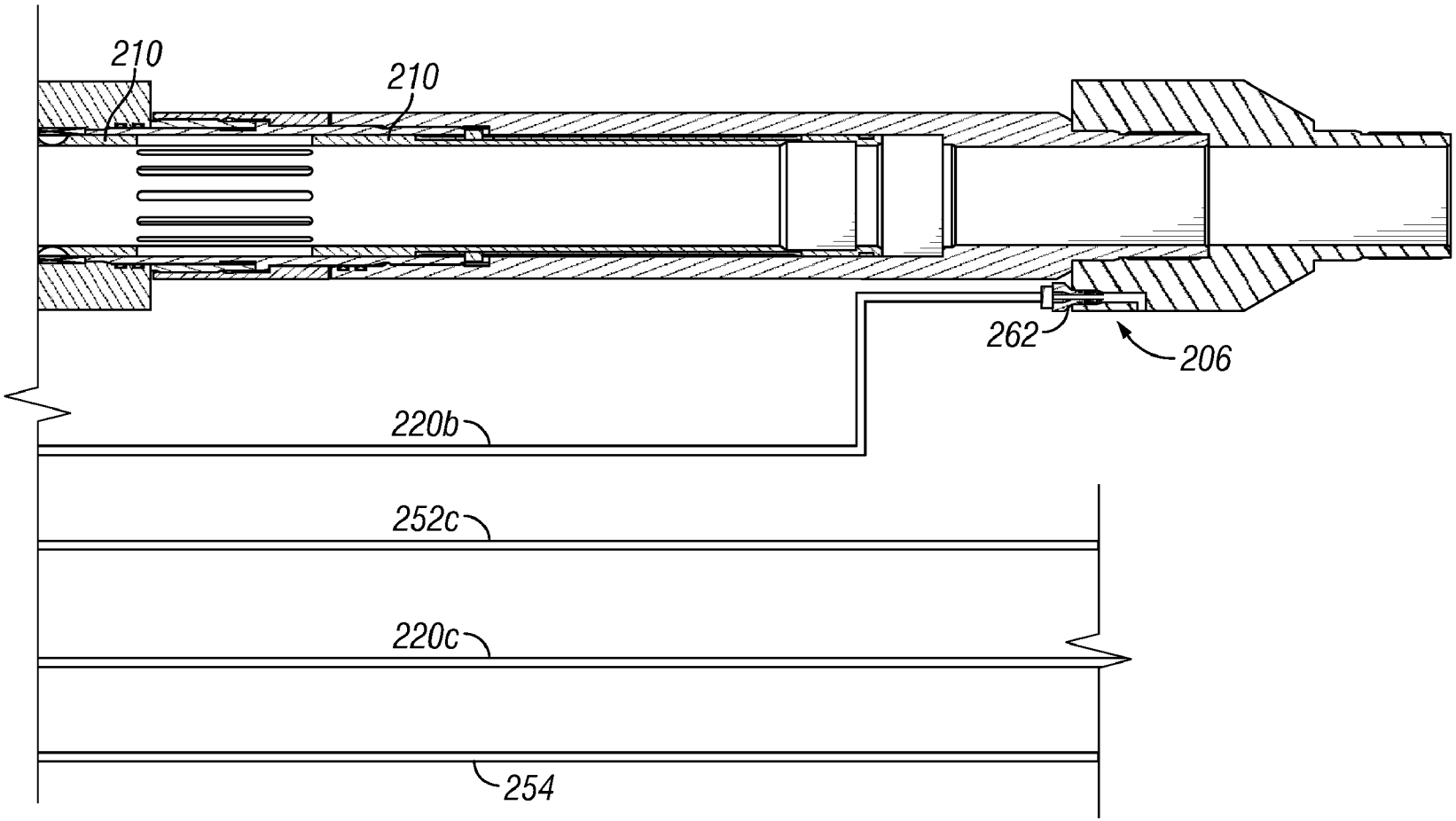
Figure 3:
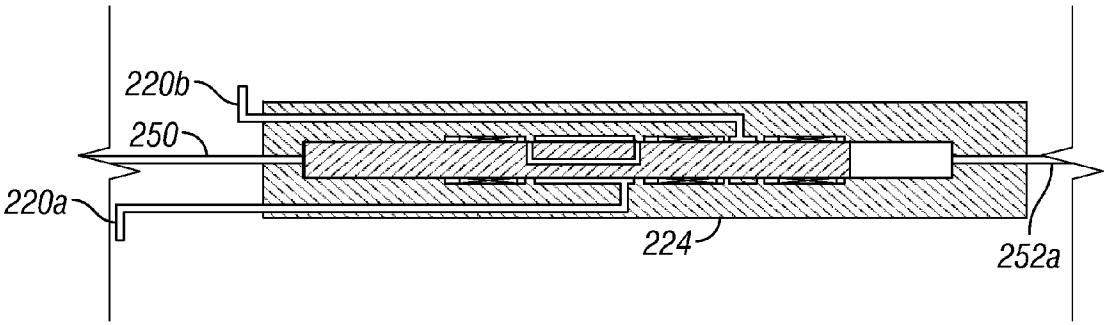
FIG. 3 illustrates an injection valve in a closed position, according to an embodiment of the present disclosure.

As illustrated in FIG. 2A, an open control line 250 can be in fluid communication with both an injection valve 224 via line portion 250*a* and the valve sleeve 210 (FIG. 2B) via line portion 250*b*. A close control line 252 can be in fluid communication with both the injection valve 224 via line portion 252*a*, as shown in FIG. 2B, and the valve sleeve 210 via line portion 252*b*. The open control line 250 and close control line 252 provide a hydraulic activation mechanism for opening and closing valve 224 and valve sleeve 210. Open control line 254 and close control line portion 252*c* can also provide a hydraulic activation mechanism for additional injection valves (not shown). Valve 224 is illustrated in the open position in FIGS. 2A to 2C and in the closed position in FIG. 3.

Referring to FIG. 2A, fluid injection line 220 can be in fluid communication with injection valve 224 via line portion 220*a*. A fluid injection line portion 220*b* provides fluid connection between injection valve 224 and a desired injection point 262 (FIG. 2C) where injection fluid is to be introduced into a flow zone 206. Fluid injection line portion 220*c* can be fluidly connected to additional injection valves (not shown).

Injection valve 224 can be any suitable type of valve that can allow flow of injection fluid through the injection line 220 into the desired flow zone 206 when the valve sleeve 210 is in the open position; and stop flow of injection fluid through the injection line 220*b* when the valve sleeve 210 closes. In an embodiment, injection valve 224 is a spool valve that is designed to fit into a production tubing assembly. Spool valves are generally well known in the art, and providing a suitable spool valve for the systems of the present disclosure would have been obvious to one of ordinary skill in the art. Other suitable valves include rotary valves, popet valves, or other pilot operated on/off valves.

The fluid injection line 220, open control lines 250, 254 and close control line 252 can be, for example, capillary tubing and/or small diameter bores positioned through portions of the production tubing assembly 100, or any other suitable means for providing the desired fluid flow. While the open control lines 250, 254 and close control line 252 are illustrated as hydraulic control lines, the open control lines can instead be electrical lines that can provide electrical power for activating an electric injection valve concurrently with an electrically activated valve sleeve 210, for example. In such an embodiment, the same electrical signal can be employed to activate both the injection valves and valve sleeve so as to control the flow in injection fluid into the desired flow zone.

In operation, when hydraulic fluid is employed via open control line 250 to provide activating energy to move the valve sleeve 210 to the open position, the hydraulic fluid also concurrently provides activating energy to open the injection valve 224, thereby allowing injection fluid to flow through injection lines 220*a* and 220*b*. Similarly, when hydraulic fluid is employed via close control line 252 to provide activating energy to move the valve sleeve 210 to the close position, the hydraulic fluid also provides the activating energy to close the injection valve 224, thereby stopping injection fluid flow through injection lines 220*a* and 220*b*.

By employing the designs of the present disclosure, the injection valves 124,126,224 can open and close substantially simultaneously with the valve sleeve 110,114,210. In this manner, the flow of injection fluid can automatically be routed to the appropriate flow zones 104,106,206 within a production tubing assembly as the flow of production fluid is also routed through these zones.

In the illustrated embodiments described above, the production tubing assembly 100 employs a hydraulic activating mechanism. However, any other suitable activating mechanism can be employed, such as, for example, an electrical activating mechanism.

Further production applications include the insertion of a tubing string hanging from a wireline retrievable surface controlled subsurface safety valve for velocity control. Wireline retrievable surface controlled subsurface safety valves are well known in the art. Examples of such safety valves are disclosed, for example, in U.S. patent application Ser. No. 11/916,966, file Jun. 8, 2006, to Thomas G. Hill et al., the disclosure of which is hereby incorporated by reference in its entirety.

Although various embodiments have been shown and described, the disclosure is not so limited and will be understood to include all such modifications and variations as would be apparent to one skilled in the art.

What is claimed is:

1. A production tubing assembly, comprising:

an upper flow path, a first flow zone and a second flow zone;

a first valve sleeve having an open position and a closed position, the first valve sleeve allowing fluid communication between the first flow zone and the upper flow path when the first valve sleeve is in the open position, the first valve sleeve preventing fluid communication between the first flow zone and the upper flow path when the first valve sleeve is in the closed position;

a second valve sleeve having an open position and a closed position, the second valve sleeve configured to allow fluid communication between the second flow zone and the upper flow path when the second valve sleeve is in the open position, the second valve sleeve configured to prevent fluid communication between the second flow zone and the upper flow path when the second valve sleeve is in the closed position; and a chemical injection system configured to inject an injection fluid from an injection fluid supply at a surface location comprising:

a first fluid injection line configured to inject the injection fluid into the first flow zone and a second fluid injection line configured to inject the injection fluid into the second flow zone;

a main fluid supply line configured to fluidly connect both the first fluid injection line and the second fluid injection line to the injection fluid supply;

a first injection valve configured to allow injection fluid to flow through the first fluid injection line to the first flow zone when the first valve sleeve is in the open position, the first injection valve configured to stop injection fluid flow to the first flow zone when the first sleeve is in the closed position; and a second injection valve configured to allow injection fluid to flow through the second fluid injection line to the second flow zone when the second valve sleeve is in the open position, the second injection valve configured to stop injection fluid flow to the second flow zone when the second sleeve is in the closed position.

2. The production tubing assembly of claim 1, wherein the first valve sleeve forms part of the first injection valve, the first valve sleeve being configured so that movement of the first valve sleeve opens and closes the first injection valve.

3. The production tubing assembly of claim 2, wherein the second valve sleeve forms part of the second injection valve, the second valve sleeve being configured so that movement of the second valve sleeve opens and closes the second injection valve.

4. The production tubing assembly of claim 1, further comprising an open control line to provide an activating energy to move the first valve sleeve, the open control line configured to substantially simultaneously provide an activating energy to the first injection valve and the first valve sleeve, wherein the first valve sleeve is separate from the first injection valve.

5. The production tubing assembly of claim 4, further comprising an open control line to provide an activating energy to move the second valve sleeve, the open control line configured to substantially simultaneously provide an activating energy to the second injection valve and the second valve sleeve, wherein the second valve sleeve is separate from the second injection valve.

6. The production tubing assembly of claim 4, wherein the activating energy is hydraulic.

7. The production tubing assembly of claim 4, wherein the activating energy is electrical.

8. The production tubing assembly of claim 4, wherein the first injection valve is a spool valve.

9. The production tubing assembly of claim 1, wherein the first flow zone comprises a tubing string flow path and the second flow zone comprises an annular flow path around the tubing string flow path.

10. The production tubing assembly of claim 9, wherein the first flow zone further comprises a diversion flow path and a plug positioned in the tubing string for diverting flow from the tubing string flow path through the diversion flow path to the upper flow path.

11. The production tubing assembly of claim 10, wherein the first fluid injection line is configured to inject the injection fluid into the diversion flow path.

12. The production tubing assembly of claim 10, wherein the first fluid injection line is configured to flow through the plug to inject the injection fluid into the tubing string flow path.

13. A chemical injection system for controlling injection of an injection fluid from an injection fluid supply at a surface location into a production tubing assembly having an upper flow path, a first flow zone, a second flow zone, a first valve sleeve for controlling flow between the upper flow path and the first flow zone, and a second valve sleeve for controlling flow between the upper flow path and the second flow zone, the chemical injection system comprising:

a first fluid injection line configured to inject the injection fluid into the first flow zone and a second fluid injection line configured to inject the injection fluid into the second flow zone;

a main fluid supply line configured to fluidly connect both the first fluid injection line and the second fluid injection line to the injection fluid supply;

a first injection valve configured to allow injection fluid to flow through the first fluid injection line to the first flow zone when the first valve sleeve is in an open position, the first injection valve configured to stop injection fluid flow to the first flow path when the first sleeve is in a closed position; and a second injection valve configured to allow injection fluid to flow through the second fluid injection line to the second flow zone when the second valve sleeve is in an open position, the second injection valve configured to stop injection fluid flow to the second flow zone when the second sleeve is in a closed position.

14. The chemical injection system of claim 13, wherein the first valve sleeve forms part of the first injection valve, the first valve sleeve being configured so that movement of the first valve sleeve opens and closes the first injection valve.

15. The chemical injection system of claim 14, wherein the second valve sleeve forms part of the second injection valve, the second valve sleeve being configured so that movement of the second valve sleeve opens and closes the second injection valve.

16. The chemical injection system of claim 13, further comprising an open control line to provide an activating energy to move the first valve sleeve, the open control line configured to substantially simultaneously provide an activating energy to the first injection valve and the first valve sleeve, wherein the first valve sleeve is separate from the first injection valve.

17. The production tubing assembly of claim 16, further comprising an open control line to provide an activating energy to move the second valve sleeve, the open control line configured to substantially simultaneously provide an activating energy to the second injection valve and the second valve sleeve, wherein the second valve sleeve is separate from the second injection valve.

18. A method for controlling a flow of injection fluid from a surface location into a production tubing assembly having an upper flow path, a first flow zone, a second flow zone, a first valve sleeve for controlling flow between the upper flow path and the first flow zone, and a second valve sleeve for controlling flow between the upper flow path and the second flow zone, the method comprising:

opening the first valve sleeve to flow production fluid into the upper flow path from the first flow zone, the process of opening the first valve sleeve also opening a first injection valve to flow the injection fluid through a first fluid injection line from the surface location to the first flow zone; and opening the second valve sleeve to flow production fluid into the upper flow path from the second flow zone, the process of opening the second valve sleeve also opening a second injection valve to flow the injection fluid through a second fluid injection line from the surface location to the second flow zone.

19. The method of claim 18, wherein the first valve sleeve forms part of the first injection valve, the method further comprising moving the first valve sleeve to open and close the first injection valve.

20. The method of claim 19, wherein the second valve sleeve forms part of the second injection valve, the method further comprising moving the second valve sleeve to open and close the second injection valve.

21. The method of claim 18, further comprising simultaneously providing an activating energy to the first injection valve and the first valve sleeve, wherein the first valve sleeve is separate from the first injection valve.

22. The method of claim 21, further comprising simultaneously providing an activating energy to the second injection valve and the second valve sleeve, wherein the second valve sleeve is separate from the second injection valve.

* * * * *